US007293962B2

(12) United States Patent
Fried et al.

(10) Patent No.: US 7,293,962 B2
(45) Date of Patent: Nov. 13, 2007

(54) COOLED TURBINE BLADE OR VANE

(75) Inventors: Reinhard Fried, Nussbaumen (CH); Hans Wettstein, Fislisbach (CH)

(73) Assignee: ALSTOM Technology Ltd., Baden (CH)

( * ) Notice: Subject to any disclaimer, the term of this patent is extended or adjusted under 35 U.S.C. 154(b) by 200 days.

(21) Appl. No.: 10/949,521

(22) Filed: Sep. 27, 2004

(65) Prior Publication Data

US 2005/0129508 A1 Jun. 16, 2005

Related U.S. Application Data

(63) Continuation of application No. PCT/CH03/00134, filed on Feb. 21, 2003.

(30) Foreign Application Priority Data

Mar. 25, 2002 (CH) ..... 0507/02

(51) Int. Cl.
*F01D 5/18* (2006.01)

(52) U.S. Cl. ..... 416/97 R; 415/115

(58) Field of Classification Search ..... 415/115, 415/116, 121.2; 416/90 R, 92, 96 R, 96 A, 416/97 R See application file for complete search history.

(56) References Cited

U.S. PATENT DOCUMENTS 3,527,543 A * 9/1970 Howald ..... 416/90 R
3,533,711 A 10/1970 Kercher
3,533,712 A * 10/1970 Kercher ..... 416/92
4,604,031 A 8/1986 Moss et al.

(Continued)

FOREIGN PATENT DOCUMENTS

DE 198 59 787 A1 7/1999

(Continued)

OTHER PUBLICATIONS

Search Report from CH 2002 0507/02 (Jun. 13, 2002).
Search Report from PCT/CH03/00134 (Jun. 3, 2003).

*Primary Examiner*—Richard A. Edgar
(74) *Attorney, Agent, or Firm*—Adam J. Cermak; Cermak Kenealy & Vaidya LLP

(57) ABSTRACT

A turbine blade or vane (1) has a shell (2), including a first side wall (8) and a second side wall (9), which are connected together at a leading edge (10) and at a trailing edge (11), which extend longitudinally from a root (7) to a tip (6) and which are connected together between leading edge (10) and trailing edge (11) by a plurality of inner ribs (13). In the inner region (12) of the turbine blade/vane (1), the ribs (13) form at least one cooling gas path (15), which guides a cooling gas flow from the root (7) to the tip (6) and, in the process, is deflected a plurality of times in serpentine shape from the outside to the inside and from the inside to the outside. In order to increase the life of the turbine blade/vane (1), at least one bypass opening (18) and/or at least one outlet opening (19) are arranged in the region of at least one rib (13), which deflects the cooling gas flow from the outside to the inside, the bypass opening (18) penetrating the rib (13) at the shell (2) and the outlet opening (19) penetrating the shell (2).

22 Claims, 2 Drawing Sheets

U.S. PATENT DOCUMENTS

| | | | | | |
|---|---|---|---|---|---|
| 4,753,575 | A | * | 6/1988 | Levengood et al. | 416/97 R |
| 4,820,123 | A | | 4/1989 | Hall | |
| 5,368,441 | A | * | 11/1994 | Sylvestro et al. | 416/97 R |
| 5,611,662 | A | * | 3/1997 | Cunha | 415/115 |
| 5,700,131 | A | | 12/1997 | Hall et al. | |
| 5,842,829 | A | * | 12/1998 | Cunha et al. | 415/115 |
| 5,967,752 | A | * | 10/1999 | Lee et al. | 416/97 R |
| 5,971,708 | A | * | 10/1999 | Lee | 416/97 R |
| 5,997,251 | A | * | 12/1999 | Lee | 416/97 R |
| 6,186,741 | B1 | * | 2/2001 | Webb et al. | 416/96 R |
| 6,347,923 | B1 | | 2/2002 | Semmler et al. | |

FOREIGN PATENT DOCUMENTS

| | | | |
|---|---|---|---|
| DE | 100 64 269 | A1 | 7/2002 |
| EP | 0 340 149 | A1 | 11/1989 |
| EP | 0 916 810 | A2 | 5/1999 |
| EP | 0 916 810 | A3 | 8/2000 |
| EP | 1 059 418 | A2 | 12/2000 |
| GB | 2 262 314 | A | 6/1993 |
| WO | 03/080998 | A1 | 10/2003 |

* cited by examiner

COOLED TURBINE BLADE OR VANE

This application is a Continuation of, and claims priority under 35 U.S.C. § 120 to, International application number PCT/CH03/00134, filed 21 Feb. 2003, and claims priority under 35 U.S.C. § 119 to Swiss application number 2002 0507/02, filed 25 Mar. 2002, the entireties of both of which are incorporated by reference herein.

BACKGROUND OF THE INVENTION

1. Field of the Invention

The invention relates to a turbine blade/vane.

2. Brief Description of the Related Art

Such a turbine blade/vane, which has an aerodynamically shaped shell around which flow occurs, is known from DE 198 59 787 A1. This shell has a first side wall and a second side wall, which are connected together at a leading edge at the incident flow end and at a trailing edge at the departing flow end, which extend longitudinally from a blade root to a vane tip and which are connected together between leading edge and trailing edge by a plurality of inner ribs. These ribs form two cooling gas paths on the inside of the turbine blade/vane or on the inside of the shell, which cooling gas paths respectively guide a cooling gas flow from the root to the tip of the turbine blade/vane and, in the process, deflect the cooling gas flow several times in serpentine shape from the outside to the inside and from the inside to the outside.

Such a serpentine shape cooling gas path therefore consists of a sequence of 180° reversal bends. In this arrangement, the ribs are arranged in such a way that, in one cooling gas path in the region of the leading edge and in another cooling gas path in the region of the trailing edge, they protrude inward from the shell and have an angle of approximately 45° relative to the blade/vane root. This produces an intensive retardation of the cooling gas flow, which improves the cooling effect.

Each cooling gas path begins in the blade/vane root and ends at the blade/vane tip, where the cooling gas can emerge through a cover plate arranged at the tip almost exactly into the middle of a hot gas path surrounding the turbine blade/vane.

To the extent that finer and coarser particles are entrained in the cooling gas, these can collect and be deposited in the deflection regions which deflect cooling gas flow in the direction of the blade/vane root. Because of this, a deposit layer can be formed which grows with time and which, as a rule, consists of oxides. This deposit layer usually has a lower thermal conductivity than the shell and the ribs, so that the cooling effect of the cooling gas flow is reduced in this deposit region. Local overheating can, therefore, occur in the regions of the turbine blade/vane affected, with the result that cracks, melting and structural changes can occur in the endangered regions of the blade/vane. Due to the deterioration in cooling caused by deposits, the life of the turbine blade/vane is therefore reduced.

SUMMARY OF THE INVENTION

The invention is intended to provide help in this respect. The invention is concerned with the problem of providing an improved embodiment for a turbine blade/vane of the aforementioned type, with which embodiment the required cooling performance, in particular, can be ensured for a longer time and/or the danger of deposits in the cooling gas path is reduced.

Principles of the present invention are based on the general idea of making available, with the aid of bypass openings and/or outlet openings, an alternative flow path for the particles entrained in the cooling gas flow in regions of an extreme cooling gas deflection, it being easier for the particles to follow this alternative flow path rather than the cooling gas path because of the inertia forces acting. In other words, precisely in the regions of the cooling gas path in which a particle deposition could possibly happen, a discharge of the particles from these regions is made possible by means of bypass openings and/or outlet openings and, in this way, their deposition in these deflection regions is prevented. Because, by this means, embodiments adhering to the principles of the present invention prevent or at least inhibit the formation of a deposit layer, the cooling effect of the cooling gas flow can be ensured for a substantially longer time, so that the life of the turbine blade/vane is increased.

According to the present invention, the proposed bypass openings on the shell penetrate one of the ribs so that the resulting bypass flow remains in the cooling gas path. In the region of a rib arranged at the tip, the bypass opening at the shell can penetrate a cover plate arranged at the tip, the bypass flow then emerging into the hot gas path. The outlet openings proposed, according to the invention, penetrate the shell in the region of a rib, so that the cooling gas emerges through these outlet openings into the hot gas path. In the case of correspondingly dimensioned outlet openings, a cooling gas film which is in contact with the outside of the shell can, by this means, be formed simultaneously, so that the outlet openings can also operate as film cooling openings.

Corresponding to an exemplary embodiment, the bypass openings penetrate the respective rib or the cover plate parallel to the shell and, in particular, along the inside of the shell. By means of these features, no deflection or only a minimum deflection arises for the particle path, so that the particle can, due to its inertia, easily follow this alternative flow path.

Corresponding considerations apply to the outlet openings if these penetrate the shell, in the region of the respective rib, parallel to this rib and if, in particular, they are essentially or substantially aligned with an incident flow side of the respective rib.

Corresponding to a particular exemplary development, at least one of the outlet openings can have a chamfered or rounded edge at least on the side arranged nearer to the blade/vane tip. Alternatively or additionally, at least one of the outlet openings can have a nose protruding from the shell toward the inside at its inlet on the side arranged nearer to the blade/vane root. The measures shown prevent blockage of the respective outlet opening by excessively large particles, in that geometric and/or aerodynamic measures prevent excessively large particles being able to enter the respective outlet opening.

Further important features and advantages of the turbine blade/vane according to the principles of the present invention follow from the drawings and the associated figure descriptions using the drawings.

BRIEF DESCRIPTION OF THE DRAWINGS

An exemplary embodiment of the invention is shown in the drawings and is explained in more detail in the following description, the same designations referring to the same or functionally equivalent or similar components. Diagrammatically, in each case.

DETAILED DESCRIPTION OF EXEMPLARY EMBODIMENTS

Figure 1:
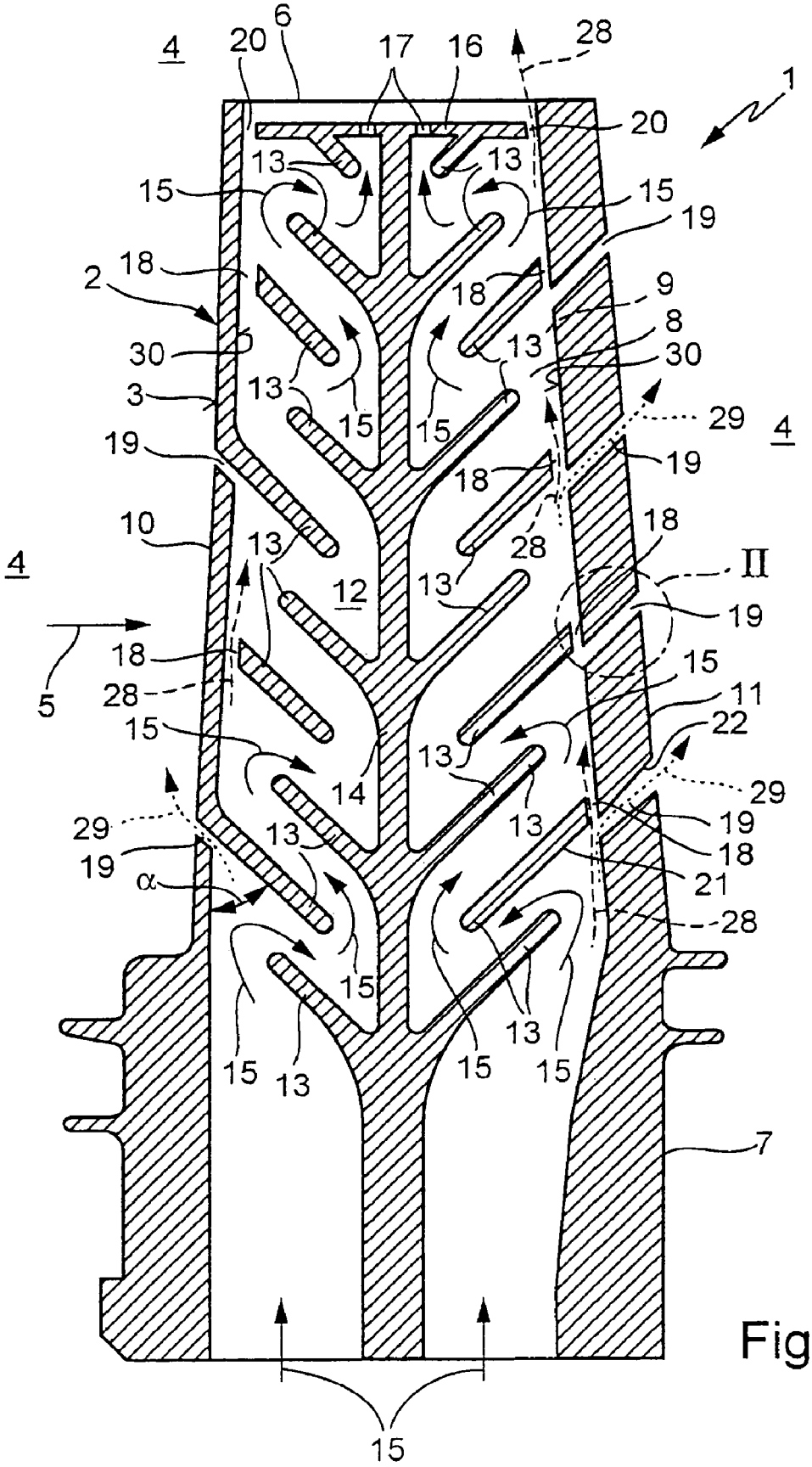
FIG. 1 shows a longitudinal section through a turbine blade/vane according to the invention.

Corresponding to FIG. 1, a turbine blade/vane 1 according to the invention, which can be configured as a rotor blade or a guide vane, has a shell 2 which is aerodynamically shaped on its outer surface 3. By means of this shell 2, the turbine blade/vane 1 extends in a hot gas path 4 of a turbine, which is not otherwise shown. The hot gas flow in the hot gas path 4 is symbolically represented by an arrow 5. The shell 2 extends longitudinally from a blade/vane tip 6, i.e. in its longitudinal direction, to a blade/vane root 7, by means of which the blade/vane 1 is anchored in the usual manner in a rotor (rotor blade) or in a casing (guide vane).

The shell 2 consists of two side walls 8 and 9, the first side wall 8 being arranged on the side of the blade/vane 1 facing away from the observer, so that only its inner surface can be recognized, and the second side wall 9 facing toward the observer, but is not recognizable due to the section selected. The two side walls 8, 9 are connected together at a leading edge 10 at the incident flow end of the blade/vane 1 and at a trailing edge 11 at the departing flow end of the blade/vane 1 and, in the process, envelope an inner region 12 of the turbine blade/vane 1.

The side walls 8, 9 are connected together in the internal region 12 by internally located or inner ribs 13. In the special embodiment shown here, approximately half of the ribs 13 (outer ribs 13) emerge from the leading edge 10 and the trailing edge 11, whereas the other half of the ribs 13 (inner ribs 13) emerge from a central web 14 which, in this case, extends over the total length of the blade/vane 1. Due to this construction, the ribs 13 form two cooling gas paths 15, through which there is parallel flow, in the inner region 12 of the blade/vane 1, which cooling gas paths 15 are designated by flow arrows in FIG. 1. Each of these cooling gas paths 15 guides a cooling gas flow from the root 7 to the tip 6 and, in the process, effects a plurality of serpentine-shaped deflections directed from the outside to the inside and subsequently from the inside to the outside.

The ribs 13 which start at the leading edge 10 and at the trailing edge 11 extend, in the process, from the shell 2 toward the inside, on the one hand, and toward the root 7, on the other, these ribs 13 including an acute angle $\alpha$, which is approximately 45° in the present case, with the shell 2 on the side facing toward the root 7. Due to this orientation of the outer ribs 13, a very strong deflection of the cooling gas flow occurs in the region of the acute angle $\alpha$, this deflection permitting an intensive heat transfer to be achieved between shell 2 and cooling gas.

In the region of its tip 6, the turbine blade/vane 1 has a cover plate 16 which contains, for each cooling gas path 15, at least one outlet opening 17 through which the cooling gas emerges into the hot gas path 4.

In the region of its ribs 13 which deflect the cooling gas flow from the outside toward the inside, i.e. in the region of its outer ribs 13 starting at the leading edge 10 and at the trailing edge 11, the turbine blade/vane 1 has, according to the invention, bypass openings 18 and outlet openings 19. In this arrangement, the bypass openings 18 are arranged in such a way that they penetrate the respective rib 13 at the shell 2. In contrast to this, the outlet openings 19 are arranged in such a way in the region of the respective rib 13 that, in the case of this rib 13, they penetrate the shell 2.

In this case, furthermore, at least one respective bypass opening 20 is also provided in the cover plate 16 for each cooling gas path 15, which bypass opening 20 penetrates the cover plate 16 at the shell 2.

In the embodiment shown here, these bypass openings 18, 20 and the outlet openings 19 are respectively configured in the region of the leading edge 10 or in the region of the trailing edge 11 in the ribs 13 or in the cover plate 16 or in the shell 2.

Figure 2:
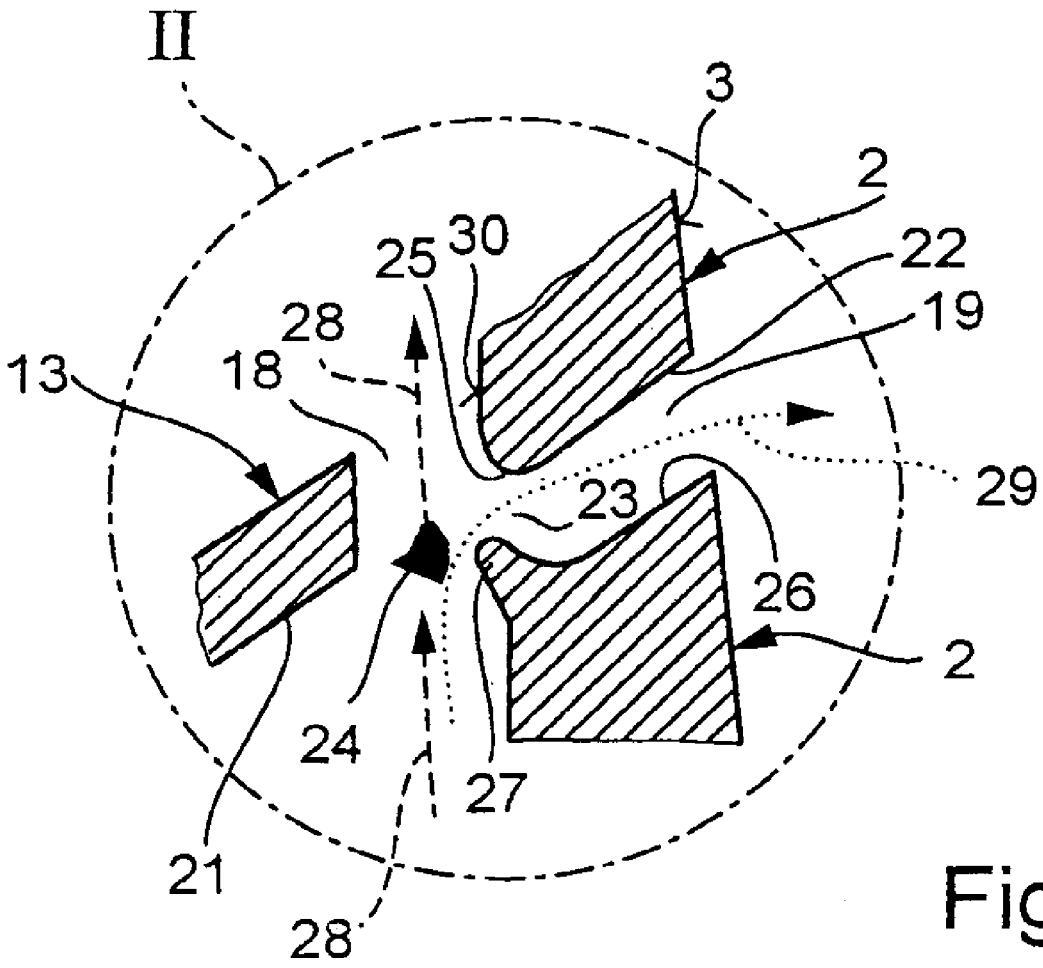
FIG. 2 shows an enlarged view of a detail II from FIG. 1.

The bypass openings 18 and 20 are expediently arranged in such a way that, as in FIG. 2, they penetrate the respective rib 13 or the cover plate 16 parallel to the shell and, in particular, along an inner surface 30 of the shell 2. In the cooling gas path 15 shown to the right in FIG. 1, the outer ribs 13 following sequentially along the shell 2 are respectively equipped with a bypass opening 18 of such a type that a plurality of, in particular all, the bypass openings 18 and 19 are arranged, in this special embodiment, in such a way that they are aligned relative to one another. In contrast to this, in the case of the flow path 15 shown on the left in FIG. 1, bypass openings 18 and outlet openings 19 are arranged alternatively in the case of the outer ribs 13 following sequentially along the wall 2.

The outlet openings 19 expediently penetrate the shell 2 parallel to the respective outer rib 13. Corresponding to the advantageous embodiment shown here, the outlet openings 19 are then positioned in such a way that they are essentially aligned with an incident flow side 21 of the respective rib 13. In the present case, a side 22 of the outlet opening 19, which side 22 is arranged nearer to the tip 6, is then aligned with this incident flow side 21. This relationship is, as an example, shown more precisely in FIG. 1 in the cooling gas path 15 shown on the right in the case of the lowest outer rib 13. In addition, a special embodiment for the outlet opening 19, which has a cross section widening from the inside to the outside, is shown in the case of this lower outer rib 13. The throttling resistance of the outlet opening 19 can be designed in an appropriate manner by means of the cross-sectional geometry.

Corresponding to FIG. 2, at least one of the outlet openings 19 can be configured by special measures at its inlet 23 in such a way that larger particles 24, which are entrained by the cooling gas flow, are prevented from entering the outlet opening 19. By this means, blockage of the outlet opening 19 by excessively large particles 24 can be avoided. As an example, the inlet 23 can have a chamfered or rounded edge 25 at least on the side arranged nearer to the tip 6, which chamfered or rounded edge 25 makes it more difficult for larger particles 24 to enter the outlet opening 19. Additionally or alternatively, a nose 27 can be configured at the inlet 23 on a side 26, of the outlet opening 19, arranged nearer to the root 7, which nose 27 protrudes inward from the shell 2 and, by this means, effects an aerodynamic deflection of the particles 24. This measure also prevents larger particles 24 from being able to enter the outlet opening 19. The bypass openings 18 expediently possess a larger cross section than the outlet openings 19.

It is clear that the bypass openings 18, on the one hand, and the outlet openings 19, on the other, are dimensioned in such a way that, as before, a sufficiently large cooling gas flow can be ensured through the cooling gas path or cooling gas paths 15.

The turbine blade/vane 1 according to the invention functions as follows:

The cooling gas flow comes from the blade/vane root 7 and the major part of it follows the cooling gas path 15 along the flow guidance ribs 13. The cooling gas flow entrains small particles, for example with a diameter of less than 0.5 mm, and larger particles, for example with a diameter of approximately 0.5 mm to approximately 3 mm. In the region of a flow deflection between an outer rib 13 and the shell 2, the particles 24 entrained in the flow cannot readily follow this strong deflection because, due to the inertia forces, they fundamentally follow a straight track. This information is utilized by the invention because it is precisely there that the bypass openings 18, 20 and the outlet openings 19 are arranged. Correspondingly, heavy coarse particles 24, in particular, can flow through the bypass openings 18 of the respective rib 13, corresponding to an arrow 28 represented by an interrupted line. Smaller particles 24 can likewise flow through the bypass opening 18. In addition, smaller particles 24 can also flow through the outlet opening 19, corresponding to an arrow 29 designated by a dotted line, and enter the hot gas path 4 through the shell 2. The pressure drop at the outlet opening 19 then favors the entry of lighter particles 24 into the outlet opening 19 whereas heavier particles 24 tend to flow through the bypass opening 18. This correspondingly applies to the bypass opening 20 in the cover plate 16 which, in the region of this bypass opening 20, takes over the function of the outer rib 13, i.e. the flow deflection. The particles 24 likewise reach the hot gas path 4 through the bypass opening 20.

With the aid of the bypass openings 18, 20 and the outlet openings 19, deposition in the deflection region between rib 13 and shell 2 and between cover plate 16 and shell 2 is effectively prevented. Because, therefore, in the case of the turbine blade/vane 1 according to the invention, material deposits are avoided or inhibited within the cooling gas paths 15, the required cooling effect can be ensured for a long time, this being associated with an increased life of a turbine blade/vane 1.

LIST OF DESIGNATIONS

1 Turbine blade/vane
2 Shell
3 Outer surface of 2
4 Hot gas path
5 Hot gas flow
6 Tip of 1
7 Root of 1
8 First side wall of 2
9 Second side wall of 2
10 Leading edge of 1 and/or 2
11 Trailing edge of 1 and/or 2
12 Inner region of 1
13 Rib
14 Central web
15 Cooling gas path
16 Cover plate
17 Outlet opening in 16
18 Bypass opening in 13
19 Outlet opening in 2
20 Bypass opening in 16
21 Incident flow side of 13
22 Side of 19 facing toward 6
23 Inlet of 19
24 Particle
25 Rounded edge at 23
26 Side of 19 facing toward 7
27 Nose at 23
28 Flow through 18, 20
29 Flow through 19
30 Inner surface of 2

While the invention has been described in detail with reference to exemplary embodiments thereof, it will be apparent to one skilled in the art that various changes can be made, and equivalents employed, without departing from the scope of the invention. Each of the aforementioned documents is incorporated by reference herein in its entirety.

What is claimed is:

1. A turbine blade or vane comprising:

a shell including a first side wall and a second side wall, the first and second side walls being connected together at a leading edge at an incident flow end and at a trailing edge at a departing flow end, the first and second side walls extending longitudinally from a root to a tip;

a plurality of inner ribs within the shell, the first and second side walls being connected together between the leading edge and the trailing edge by the plurality of inner ribs, the plurality of inner ribs forming at least one cooling gas path on the inside of the shell, which cooling gas path is configured and arranged to guide a cooling gas when flowing from the root to the tip and deflect said cooling gas several times in a serpentine shape from the shell outside to the shell inside and from the shell inside to the shell outside, wherein the serpentine shape cooling gas path comprises a sequence of 180° reverse bends, wherein the shell outside comprises a portion of the shell including the leading edge or the trailing edge, and wherein the shell inside comprises a portion of the shell arranged between the leading edge and the trailing edge;

at least one opening in the region of at least one rib of said plurality of inner ribs, said at least one rib configured and arranged to deflect the cooling gas flow from the outside to the inside, said at least one opening comprising (a) at least one bypass opening penetrating said at least one rib at the shell, or (b) at least one outlet opening penetrating the shell at at least one rib, or both (a) and (b), said at least one opening being positioned (c) at the leading edge or (d) at the trailing edge; and wherein the serpentine shape cooling gas path and the at least one opening are together positioned and arranged to guide all of the cooling gas when flowing inside said shell to flow through said sequence of 180° reverse bends or through said at least one opening.

2. The turbine blade or vane as claimed in claim 1, further comprising:

a cover plate arranged at the tip; and wherein the at least one bypass opening includes at least one cover plate bypass opening penetrating the cover plate at the shell.

3. The turbine blade or vane as claimed in claim 2, wherein the at least one bypass opening penetrates the at least one rib parallel to the shell or the at least one cover plate bypass opening penetrates the cover plate parallel to the shell.

4. The turbine blade or vane as claimed in claim 2, wherein the at least one bypass opening penetrates the at least one rib along an inner surface of the shell or the at least one cover plate bypass opening penetrates the cover plate along an inner surface of the shell.

5. The turbine blade or vane as claimed in claim 2, wherein the at least one bypass opening penetrates the at least one rib parallel to the shell and the at least one cover plate bypass opening penetrates the cover plate parallel to the shell.

6. The turbine blade or vane as claimed in claim 2, wherein the at least one bypass opening penetrates the at least one rib along an inner surface of the shell and the at least one cover plate bypass opening penetrates the cover plate along an inner surface of the shell.

7. The turbine blade or vane as claimed in claim 1, wherein the at least one bypass opening penetrates the at least one rib parallel to the shell.

8. The turbine blade or vane as claimed in claim 1, wherein the at least one bypass opening penetrates the at least one rib along an inner surface of the shell.

9. The turbine blade or vane as claimed in claim 1, wherein the at least one outlet opening penetrates the shell parallel to the at least one rib.

10. The turbine blade or vane as claimed in claim 1, wherein the at least one outlet opening has a cross section which widens from the inside to the outside.

11. The turbine blade or vane as claimed in claim 1, wherein the at least one outlet opening is substantially aligned with an incident flow side of the at least one rib.

12. The turbine blade or vane as claimed in claim 1, wherein the at least one outlet opening comprises an inlet including a chamfered or rounded edge at least on a side arranged nearer to the tip.

13. The turbine blade or vane as claimed in claim 12, wherein the at least one outlet opening comprises a nose protruding inward from the shell on a side arranged closer to the root.

14. The turbine blade or vane as claimed in claim 1, wherein said at least one bypass opening includes a plurality of bypass openings arranged so that they are aligned with one another.

15. The turbine blade or vane as claimed in claim 1, comprising:

sequential ribs;

wherein the at least one bypass opening and the at least one outlet opening are arranged to alternate with one another.

16. The turbine blade or vane as claimed in claim 1, wherein the at least one opening comprises at least one bypass opening arranged (e) in the region of the leading edge or (f) in the region of the trailing edge.

17. The turbine blade or vane as claimed in claim 1, further comprising:

ribs which protrude from the shell toward the inside and toward the root; and wherein the at least one bypass opening, the at least one outlet opening, or both, are arranged at said protruding ribs.

18. The turbine blade or vane as claimed in claim 1, wherein the at least one outlet opening comprises a nose protruding inward from the shell on a side arranged closer to the root.

19. The turbine blade or vane as claimed in claim 1, wherein the plurality of inner ribs form at least two cooling gas paths on the inside of the shell, and wherein said at least one opening comprises at least two openings positioned at (c) and (d).

20. The turbine blade or vane as claimed in claim 1, wherein the at least one opening comprises at least two bypass openings arranged (e) in the region of the leading edge and (f) in the region of the trailing edge.

21. The turbine blade or vane as claimed in claim 1, wherein the at least one bypass opening penetrates the same at least one rib at which the at least one outlet opening penetrates the shell.

22. The turbine blade or vane as claimed in claim 1, wherein the at least one rib which the at least one bypass opening penetrates is different from the at least one rib at which the at least one outlet opening penetrates the shell.

* * * * *